US005630676A

United States Patent [19]

Junker

[11] Patent Number: 5,630,676

[45] Date of Patent: May 20, 1997

[54] MARKER BUMP FOR PLACEMENT ON TRAFFIC LANE

[76] Inventor: Wilhelm Junker, Reutlingerstrasse 14, 71522 Backnang, Germany

[21] Appl. No.: 442,727

[22] Filed: May 17, 1995

[30] Foreign Application Priority Data

Jan. 26, 1995 [DE] Germany ..... 295 01 223.4

[51] Int. Cl.[6] ..... E01F 9/04; E01F 9/06

[52] U.S. Cl. ..... 404/12; 404/15; 59/78; 59/85

[58] Field of Search ..... 404/9, 12, 13, 404/14, 15, 93, 94, 16; 116/63 R; 256/1, 13.1, 19, DIG. 6, 65, 66; 59/78, 84, 85, 90, 95, 900, 901; 160/35, 36, 229.1; 198/850, 851, 853

[56] References Cited

U.S. PATENT DOCUMENTS

| | | | |
|---|---|---|---|
| 1,683,121 | 9/1928 | Baldwin | 404/13 |
| 3,278,000 | 10/1966 | I'Anson | 59/85 X |
| 4,469,221 | 9/1984 | Albert | 198/851 |
| 4,776,454 | 10/1988 | Momose | 59/78 X |
| 5,099,904 | 3/1992 | Susnar | 160/229.1 X |
| 5,197,274 | 3/1993 | Braun | 59/78 X |

FOREIGN PATENT DOCUMENTS

| | | | |
|---|---|---|---|
| 1403200 | 5/1965 | France | 59/901 |
| 2656870 | 6/1977 | Germany | 160/35 |
| 3905372 | 5/1990 | Germany . | |

*Primary Examiner*—James Lisehora
*Attorney, Agent, or Firm*—Jordan and Hamburg

[57] ABSTRACT

A marker bump for placement on a traffic lane, particularly for marking a traffic lane when the course of traffic is changed at construction sites or the like, comprises links, joined in an articulated manner with one another to form a link chain and preferably having a warning color on their upper side. The links are connected with one another over a connecting link, which in each case is hinged on its own pin to the adjacent link. The two links, which are to be joined to one another, in each case having a recess for accommodating the connecting link.

7 Claims, 4 Drawing Sheets

MARKER BUMP FOR PLACEMENT ON TRAFFIC LANE

BACKGROUND OF THE INVENTION

The invention relates to a marker bump.

A marker bump of this type has become known from the German patent 39 05 372. For this, the individual links are joined together in such an articulated manner, that a single articulated pin is provided. This articulated pin is provided in each case between a projection in one link and a recess on the opposite side of the link accommodating this projection. This type of articulated joint, for which the adjacent links can be swiveled only up to an angle limited by the collision of the links with one another, permits the link chain to be rolled up on a drum or the like or unrolled from the drum or the like.

As a result of the rolling up of the link chain in the form of a spiral, for example, on a drum, the stored link chain has an unmanageable volume. It is also necessary, when the link chain is laid down from a moving vehicle, that a drum that can rotate be disposed on the vehicle.

SUMMARY OF THE INVENTION

It is an object of the invention to improve the stacking of the link chain also with respect to pulling off the chain from a moving vehicle.

Due to the arrangement of a connecting link, in which the links to be connected are supported by their own pin, the links can be swiveled through a full circle relative to one another. In the stacked position, the links lie flat against one another, so that the whole of the link chain can be assembled into a block, from which it can also be pulled off without a drum that can rotate. The distance of the pins from one another is at least as large as the thickness of the link chain.

BRIEF DESCRIPTION OF THE DRAWINGS

The invention is explained in greater detail in the following by means of an embodiment represented in the drawing, in which.

DETAILED DESCRIPTION OF THE INVENTION

Figure 1:
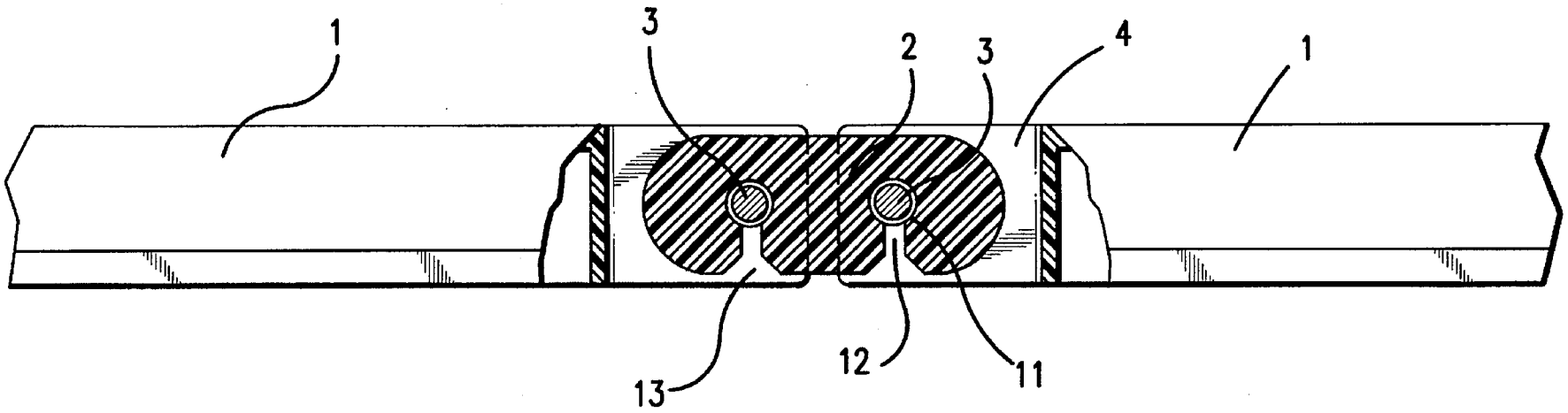
FIG. 1 shows a section through the connection site between two links along the line A—A of FIG. 2.
Figure 2:
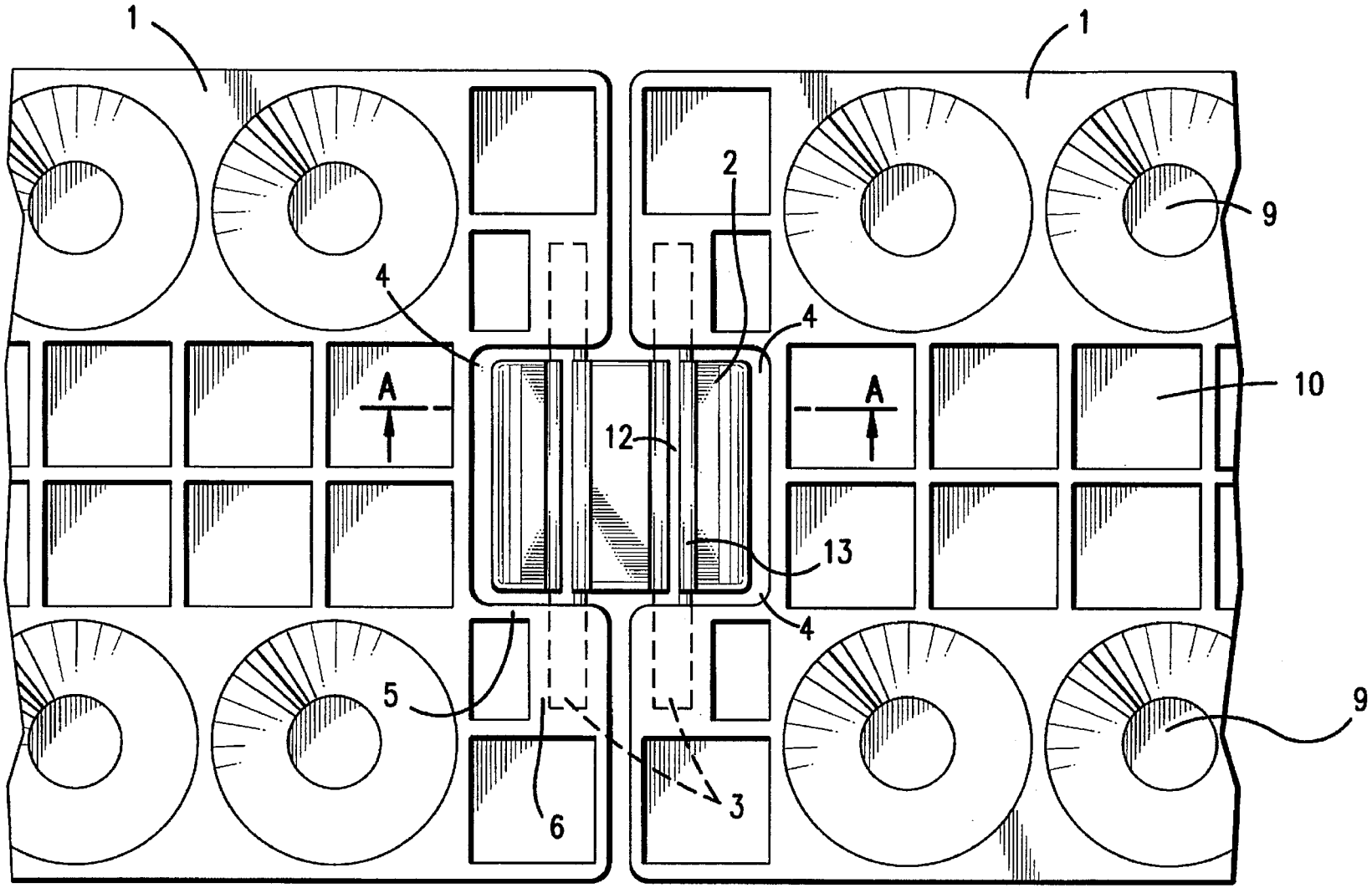
FIG. 2 is a plan view of two links.
Figure 3:
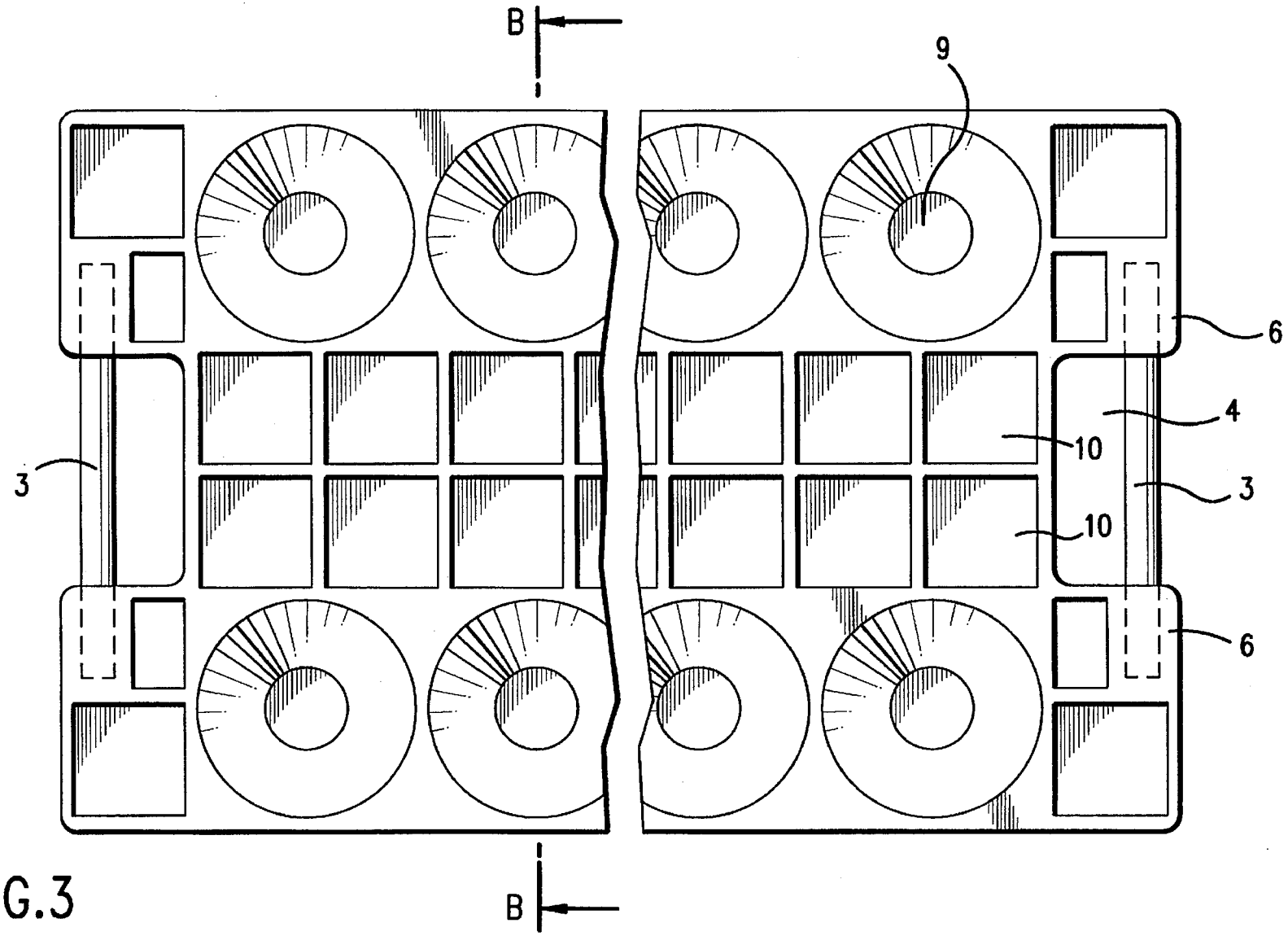
FIG. 3 is a plan view of a link.
Figure 5:
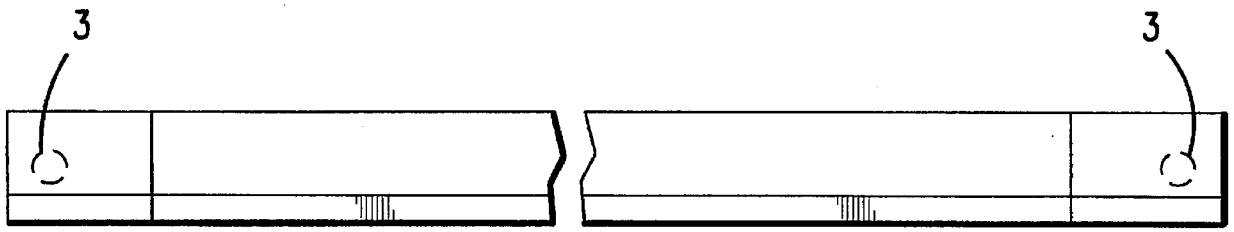
FIG. 5 is a longitudinal side view of a link.
Figure 4:
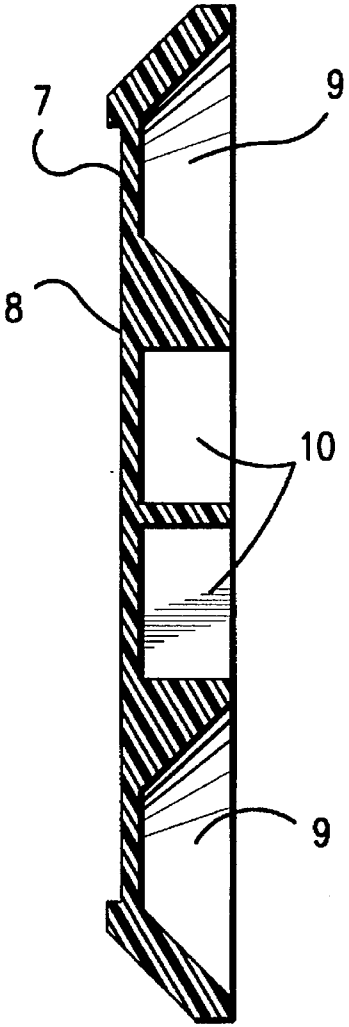
FIG. 4 is a section along the line B—B of FIG. 3.

The marker bump consists of links 1, which are connected to one another in an articulated fashion and together form a link chain. A connecting link 2, which engages recesses 4 in the front side or the back side of adjacent links 1, serves to connect the links 1 together.

The links 1 have, for example, a length of about 50 cm, a width of about 15 cm and a thickness of about 2 cm. The links 1 consist of plates, which are produced preferably from a plastic material. The plates have a covering layer 7 on their upper side. A depression 8 in this covering layer 7 serves to accommodate a warning color. At the underside of each link 1, truncated cone recesses 9 and cuboidal recesses 10 are disposed adjoining the covering layer 7. The truncated cone recesses 9 are in the longitudinal edge regions and the cuboidal recesses 10 are in the middle region of the link 1. A sort of lattice structure is formed by the walls of the recesses 9 and 10. The lattice structure serves to save material and also results in the advantage that the danger of the marker bump being shifted on the lane is reduced. The latter is achieved particularly by the truncated cone shape of the recesses 9.

Pins 3 are mounted in walls 5, which form the lateral boundary of recesses 4 in the longitudinal direction of the link chain. This mounting is accomplished by securely molding the pins 3 into the material of the walls 5 the naterial and of reinforcements 6 disposed in this region. These pins 3 thus cannot be moved relative to the links 1.

The side walls of each link 1, running in the longitudinal direction of the link chain, are disposed at an angle to the underside.

The connecting link 2 has two cylindrical recesses 11 for accommodating the pins 3. These recesses 11 run parallel to one another and transversely to the link chain. In each case, the recess opens into a gap 12 with the underside of the connecting link 2, which consists of an elastically yielding material, such as a plastic material. The distance between the walls bounding this gap 12 is less than the diameter of the pins 3. The purpose of this is to press connecting link 2 onto the pins 3 mounted rigidly in the links 1 that are to be connected with one another. To improve the introduction of the pins 3, each gap 12 is provided with a funnel-shaped mouth 13.

When the connecting link 2 is being pressed onto the pin 3, the latter is introduced over the funnel-shaped mouths 13 into the gap 12 to force the gap 12 apart by elastic deformation of the material of the connecting link 2, until the pins 3 reach the recesses 11. This connection can be loosened only by exerting a considerable force.

The distance from one another of the recesses 11 disposed in the connecting link 2 is at least as large as the thickness of a link 1. Moreover, a lesser distance is provided between the links 1 of the laid-out link chain. By these means, it is possible that the links 1, lying against one another, form a compact block. This reduces to a minimum the volume of a link chain made ready for laying and, moreover, also enables the link chain to be pulled off from a vehicle without the use of a drum or the like.

A clearance is provided between the pins 3 and the recesses 11. By these means, it becomes possible to place the link chain down also in a slight curve.

I claim:

1. A marker bump comprising a plurality of plates connected in an articulated manner with one another, each of said plates having a notch recess on opposed longitudinal ends thereof, the recesses of neighboring plates being adjacent; a plurality of linking means, each of said plurality of linking means connecting one of said plurality of plates to another one of said plurality of plates, each of said linking means being disposed within adjacent ones of said recesses; a plurality of hinging means for hingeably mounting each linking means to respective adjacent ones of said plurality of plates, each of said plurality of hinging means including a pin disposed within each recess having a linking means therein; each linking means having a groove in opposite ends thereof, each groove rotatably accepting each respective hinging means disposed in the recess of each neighboring plate; and the groove in each linking means being laterally bounded in the lateral direction of the marker bump by the recess in which each pin is disposed.

2. The marker bump of claim 1, further comprising walls bounding each recess, the walls being reinforced.

3. The marker bump of claim 1, wherein the longitudinal cross section of each of said plurality of linking means is substantially a rectangle with rounded off edges.

4. The marker bump of claim 1, wherein the diameter of each pin is smaller than the groove which accepts it.

5. The marker bump of claim 1, wherein the distance between pins disposed within adjacent ones of said recesses is at least as large as the thickness of each of said plurality of plates.

6. A marker bump comprising a plurality of plates connected in an articulated manner with one another, each of said plates having a notch recess on opposed longitudinal ends thereof, the recesses of neighboring plates being adjacent; a plurality of linking means, each of said plurality of linking means connecting one of said plurality of plates to another one of said plurality of plates, each linking means being disposed within adjacent ones of said recesses; a plurality of hinging means for hingeably mounting each linking means, each of said plurality of hinging means including a pin disposed within each recess having a linking means therein, each linking means having a groove in opposite ends thereof, each groove rotatably accepting each respective hinging means disposed in the recess of each neighboring plate; each linking means being an elastically yielding material, each groove being cylindrical and opening into a gap through which each pin enters each groove, and the distance between the walls of the gap being smaller than the diameter of the pins.

7. A marker bump comprising a plurality of plates connected in an articulated manner with one another, each of said plurality of plates including an underside having a central region bounded by longitudinal edge regions, cuboidal recesses being disposed in the central region of the underside of each link and truncated cone recesses being disposed in the longitudinal edge regions, each of said plates having a notch recess on opposed longitudinal ends thereof, the recesses of neighboring plates being adjacent; a plurality of linking means, each of said plurality of linking means connecting one of said plurality of plates to another one of said plurality of plates, each linking means being disposed within adjacent ones of said recesses; and a plurality of hinging means for hingeably mounting each linking means, each of said plurality of hinging means including a pin disposed within each recess having a linking means therein, each linking means having a groove in opposite ends thereof, each groove rotatably accepting each respective hinging means disposed in the recess of each neighboring plate.

* * * * *